US010053829B2

(12) United States Patent
Watson

(10) Patent No.: US 10,053,829 B2
(45) Date of Patent: Aug. 21, 2018

(54) FLASHBOARD RISER SYSTEM AND METHOD FOR WATER MANAGEMENT

(71) Applicant: Norman Paul Watson, Ridgeland, MS (US)

(72) Inventor: Norman Paul Watson, Ridgeland, MS (US)

( * ) Notice: Subject to any disclaimer, the term of this patent is extended or adjusted under 35 U.S.C. 154(b) by 0 days.

(21) Appl. No.: 15/018,306

(22) Filed: Feb. 8, 2016

(65) Prior Publication Data

US 2016/0230363 A1 Aug. 11, 2016

Related U.S. Application Data

(60) Provisional application No. 62/113,005, filed on Feb. 6, 2015.

(51) Int. Cl.

| | |
|---|---|
| ***E02B 7/40*** | (2006.01) |
| ***E02B 7/34*** | (2006.01) |
| ***E03F 5/10*** | (2006.01) |

(52) U.S. Cl.

CPC ..... *E02B 7/40* (2013.01); *E02B 7/34* (2013.01); *E03F 5/107* (2013.01)

(58) Field of Classification Search

USPC ..... 405/87, 92, 98–101

See application file for complete search history.

(56) References Cited

U.S. PATENT DOCUMENTS

| | | | | |
|---|---|---|---|---|
| 3,974,654 | A * | 8/1976 | Mirto, Jr. | E02B 8/045 137/409 |
| 4,073,147 | A | 2/1978 | Nomura | |
| 4,455,106 | A | 6/1984 | Johnson | |
| 5,516,230 | A | 5/1996 | Bargeron et al. | |
| 6,171,023 | B1 | 1/2001 | Townshend | |
| 6,427,718 | B1 | 8/2002 | Stringam et al. | |

(Continued)

FOREIGN PATENT DOCUMENTS

| | | | |
|---|---|---|---|
| EP | 1830005 | B1 | 3/2012 |
| WO | 03083223 | A1 | 10/2003 |
| WO | 2012090984 | A1 | 7/2012 |

OTHER PUBLICATIONS

Cooke, et al., "Infinitely-Variable, Automated Control Structure for Drainage Water Management", Department of Crop Sciences at http://agronomyday.cropsci.illinois.edu/2004/Tour_A/Auto_Control/, printed Aug. 26, 2014, 1 page, 2004 University of Illinois.

(Continued)

*Primary Examiner* — Sean D Andrish

(74) *Attorney, Agent, or Firm* — Berg Hill Greenleaf & Ruscitti, LLP

(57) ABSTRACT

An automated flashboard riser device comprises a housing with a rotatable gate that can be incrementally positioned to control flow of water over an upper edge of the gate. The device is installed at a control point in an impoundment area, such as a settling pond. The gate is raised and lowered by rotation of the gate about a hinge. Automatic control is provided for operation of the gate by a controller communicating with an actuator. A system of the invention includes the automated flashboard riser device and the controller. A method of the invention includes controlling flow of water from an impounded water source by use of the automated flashboard riser device. Manual or non-automated embodiments are also disclosed.

18 Claims, 9 Drawing Sheets

(56) References Cited

U.S. PATENT DOCUMENTS

| | | | | |
|---|---|---|---|---|
| 6,467,998 | B1 * | 10/2002 | Timms | E02B 7/205 405/103 |
| 6,719,491 | B2 | 4/2004 | Kezele et al. | |
| 7,083,359 | B2 * | 8/2006 | Aughton | E02B 7/26 405/100 |
| 7,114,878 | B2 | 10/2006 | Craig et al. | |
| 7,726,907 | B2 | 6/2010 | McCreedy et al. | |
| 7,785,042 | B2 * | 8/2010 | Scandaliato | E02B 3/10 405/284 |
| 8,246,272 | B1 * | 8/2012 | Heitz | E06B 9/04 405/105 |
| 8,333,895 | B2 | 12/2012 | Albers et al. | |
| 8,457,799 | B2 | 6/2013 | Cox | |
| 8,474,327 | B2 | 7/2013 | Aughton et al. | |

OTHER PUBLICATIONS

SlipMeter™, http://www.rubiconwater.com.au/catalogue/slipmeter-usa, 3 pages, Rubicon Water 2014.

* cited by examiner

FLASHBOARD RISER SYSTEM AND METHOD FOR WATER MANAGEMENT

FIELD OF THE INVENTION

The invention relates to water management control devices and systems, and more particularly, to an automated water control device in the form of a flashboard riser device, a water control system incorporating the flashboard riser, and a method for water management utilizing the automated flashboard riser. Embodiments also include an automated flashboard riser device

BACKGROUND OF THE INVENTION

Water impoundment areas are integral aspects of land and water management both in modern and ancient times. These areas can be generally characterized as areas of land that hold non-flowing water originating from natural flowing water sources or man-made water sources. Impoundment areas can be areas set aside for controlling water quality, such as settling ponds, in which sediment and impurities are allowed to settle out of a body of water before the water is allowed to be transported downstream. Modern land and water quality management practices still rely on use of impoundment areas including settling ponds and other non-flowing bodies of water. Landscapes are often altered in agricultural and industrial efforts in which natural drainage must be changed to prevent undesirable erosion or damage to the altered landscapes. Alteration may inevitably create excess sediment and may introduce undesirable minerals or other pollutants into a drainage area. Government regulation also plays an important factor in water management, and government water quality standards may require water to be impounded and treated prior to release of water from a regulated activity.

Some basic principles for construction and maintenance of impoundment areas are common to both modern and ancient times. One basic principle is that the water to be impounded is held in a basin until settling of sediments and impurities can occur. If a rain event or other cause of flooding results in overflow of the basin, then another principle is to allow only the top of the water column to be discharged downstream, either by overflowing the bank or spillway of the basin, or by water flow control over a water control device incorporated within the basin. Since the top of the water column almost always contains the purest water, sediment, contaminants, and other non-desirable materials are held in the settling pond while the top of the water column may be released. This simple method of water control has been documented to greatly improve downstream water quality while virtually eliminating on-site soil erosion.

One common form of a water control device or gate is referred to as a "flashboard riser". This type of water control gate may be constructed of a barrier housing, such as a half pipe shaped member cut from culvert pipe material, with a drain pipe connected to an opening formed in the housing. The flashboard riser is typically installed within an earthen dam such that the earthen dam covers the drain pipe. The front face of the housing is immersed in the water. The drain pipe communicates with a downstream drainage device or another body of water. The front face of the housing has aligned slots which receive cut boards placed in the slots. The boards form a wall of a selected height depending on the number and width of the boards chosen. The impoundment of water is achieved in which only the top of the water column is able to be discharged as it overflows or overtops the top board of the riser. Boards can be added or removed one at a time to account for changes in the level of the water in the basin or settling pond, thereby providing a simple yet reliable means of incremental control for discharge of water from the settling pond. Examples of where these types of flashboard risers are typically installed include agricultural fields surrounded by relatively low levees, wooded areas where water may be held periodically, and construction sites where soil is disturbed and runoff water impoundment is required.

Although traditional flashboard risers have great utility in diverse water containment applications, there are a number of problems associated with these risers. For example, boards must be individually cut for the housing of each riser. In agricultural applications, farmers may have numerous types of flashboard riser with housings that each requires different sized boards in terms of both width and length. It is known to use boards with interlocking edge surfaces, but these still suffer some amount of leakage and therefore, plastic sheeting may be required to better seal the riser from leakage between boards. Plastic sheeting also becomes a problem in that it must be manually installed with the boards, and it is difficult to effectively encapsulate the boards exposed to water in the pond. Wooden boards swell over time as they immersed in water, thereby making it difficult to remove the boards from the slots in the housing. In general, boards cannot be reused, and are difficult to raise or lower once installed.

Various types of automatic water control gates are available, but these water control gates are relatively expensive to purchase and install. Due to cost constraints, particularly for agricultural applications in which a large number of flashboard risers may be required, it is not economically feasible to install an automatic water control gate at each required location.

Therefore, there is a need to provide a simple yet reliable water control device that can function similar to a traditional flashboard riser, but which avoids manual labor disadvantages associated with cutting and replacing boards. There is also a need to provide a water control device in which incremental control is achieved with respect to the height of the water column allowed to overflow the water control device. There is also a need for the incremental control of the height of the water column released by the water control device to be achieved with minimal or no manual effort to adjust or manipulate each water control device. There is also need to provide a water control device that reduces operator time and effort associated with standard operation and maintenance.

SUMMARY OF THE INVENTION

According to one aspect of the invention, it includes an automated flashboard riser device. According to one preferred embodiment of the invention, the flashboard riser device comprises a housing with a hinged gate that can be incrementally positioned to control flow of water over the upper edge or surface of the gate. The device is installed at the control point in an impoundment area, such as a settling pond. More specifically, the control point is a selected location where water is allowed to flow downstream from the device. The gate is raised and lowered by rotation of the gate about a hinge that extends substantially horizontally along an axis parallel to the hinge. The gate opens to the inside of the housing. The position of the gate is controlled by panel guides that extend substantially perpendicular to a panel portion of the gate. Accordingly, when the gate is closed and an upper edge of the gate is in a raised position, the panel guides protrude away from the housing. When the gate is opened and the upper edge of the gate is lowered, the panel guides along with the gate panel are withdrawn into the housing. The panel guides are received within corresponding panel guide slots formed in a front facing wall of the housing. The panel guides are generally pie shaped elements in which upper peripheral curved surfaces are received in the corresponding panel guide slots. The panel guides are rotated about the axis located generally at the vertices of converging side surfaces of the panel guides. The height of the gate may be selected to account for minimum and maximum water column levels to be encountered in the body of water in which the riser device is installed.

Control of the gate panel can be achieved both manually and automatically. In either case, one method of control may include use of a cable that is secured to the gate, and is incrementally controlled by a gear or a spool upon which the cable is wound. For example, the cable may be secured to one or more points along the upper portion of the gate, and the opposite end of the cable is routed through one or more rollers so that the cable is placed in a position to be selectively released and wound by an element that imparts a mechanical force on the cable. A rotating gear or rotating spool may provide the mechanical means to adjust the length of the cable in order to selectively raise and lower the upper edge of the gate. The mechanism by which the gate is raised and lowered may also be referred to herein as the "actuator".

If the device is to be controlled manually, one example of the actuator may include a hand crank that can be secured to a ratchet gear or wheel, and rotation of the crank clockwise or counterclockwise results in release or winding of the cable. A spring loaded pawl can be used to lock or unlock the gear/wheel.

If the device is to be controlled automatically, the actuator may include an electric motor having an output shaft connected to a shaft of the gear/wheel or to a shaft of the spool upon which the cable is wound. Power to the motor may be provided by grid power or by a local power source at the location of the device. For example, a solar panel, inverter, and battery may be located adjacent the device for powering the electric motor.

Under automatic control, a computer controller may be integrated with the power source so that the device can be programmed for automatic and remote operation.

Another feature associated with the device includes "C" hinges that allow the gate panel to be removed with simple tools. Another feature is wiper seals located adjacent the panel guides to better seal the device from leakage. Yet another feature is the use of bellow type seals located at the hinge point to prevent leakage. The seals can be replaced as necessary.

Other features associated with the device include an upper platform upon which an operator may stand for observation or repair of the device. The housing of the device may be separated from the downstream pipe by a slotted arrangement between an outflow flange that extends rearward from the housing and side slots formed on a coupler attached to the facing end of the downstream pipe which receives the outflow flange.

The actuator may also include various other types of mechanical force imparting elements such as double geared shafts, a chain and sprocket combination, a belt and sprocket combination, and other cable wrap configurations. It is preferred that actuation is achieved by rotational as opposed to linear control movement, since very fine and incremental gate panel positions may be required. Further, it is preferable that the movement of the gate be controlled in both directions; that is, control is maintained during both raising and lowering of the gate panel. Because of the incremental and constant control provided, the gate panel can be left in any desired position indefinitely. The actuator is preferably connected to the gate at least at two points along the upper portion of the gate housing such that the panel guides maintain proper alignment with the guide slots to prevent binding of the panel guides in the guide slots. Gate positions can be manually indexed for future reference, or may be automatically indexed as gate reference points in programmable control of the actuator.

According to yet further aspects of manual control, the gate position may be controlled by means of the manual crank that connects to the gate actuator component. For example, the operator may turn the crank by hand to fully or partially open or close the gate. Indexing of gate positions may be accomplished by sight referenced markers placed on the panel guides, and the operator may operate the crank to align the sight referenced markers with an index point or marker on the mechanical linkage of the actuator.

According to yet a further aspect of manual or automatic control, a "slow fall" feature is provided in which lowering of the gate is controlled by a torsion spring incorporated within the hinge (similar to a garage door spring) and/or an oil dampener incorporated with the gate. Both of these "slow fall" features are components that selectively control the rate at which the gate is allowed to lower after the initial changing of a gate position setting. This "slow fall" feature is designed for purposes of maintaining settling pond characteristics by only allowing slow release of the very top portion of the water column until the gate reaches a new set position or range limit corresponding to the gate position setting. If the gate was allowed to fall or lower too quickly, this may result in excessive turbulence in the body of water as flow of water would accelerate at a rate which may stir and suspend settled sentiment and particulate contaminants.

According to yet further aspects of automatic control, a controller used in the system can be provided with control options for gate control, such as control switches to open and close the gate, as well as control options to control the rate at which the gate is opened and closed. The controller may also be set to automatically change the position of the gate to maintain a predetermined rate of water flowing through the flashboard riser device or after a predetermined volume of water passes through the device. For example, the controller may be set to automatically raise the upper edge of the gate if a water flow meter of the device indicates the water flowing through the device exceeds a predetermined amount. Alternatively, the controller may automatically raise the upper edge of the gate after a predetermined volume of water has passed through the device. In another example, the controller can provide an alert when the flow meter of the device records a pre-set volume has passed through the device, or the rate of water flowing through the device, exceeds a pre-set amount. The controller may be programmable so that multiple flashboard riser devices may be controlled by a single controller, and each device may be separately programmed.

According to yet further aspects of automatic control, limit switches, sensors, and camera imaging may be used in an integrated control system to determine the present state of each of the devices in the system, and to observe changes to each device upon command signals sent to each.

According to yet further aspects of automatic control, the controller may be connected to a data processing system, by either a wired or wireless connection. A web-based control solution may be a preferable option for remote control of the devices. Accordingly, various control devices could be used such as smart phones, tablets, personal computers, and others. Data may be recorded for each field device, such as gate index positions, gate position history, etc. This data can be used to better predict or determine most optimal gate positions considering current environmental factors such as the current water column height and downstream flow restrictions.

According to another aspect of the invention, it may therefore be considered an integrated water control system incorporating an automated flashboard riser device. According to the system, it includes at least one automated flashboard riser device and a controller which maintains basic control of the riser device as influenced by pre-set operator parameters or settings.

According to yet another aspect of the invention, it may be considered a method for water management utilizing a manually controlled or automated flashboard riser. The method includes an observation of conditions for an impounded body of water, and determining desired and allowable runoff or drainage of the body of water. The method also includes use of a flashboard riser device that is controlled to achieve predetermined runoff or drainage requirements. The device is manipulated to incrementally raise or lower a height of the column of water in which the top portion of the water column is allowed to controllably overflow the gate of the device.

Considering the above described features and aspects of the invention and others to follow, and also considering the drawings, detailed description, and appended claims, in one particular aspect of the invention, it may be considered a flashboard riser to control flow of water from an impounded water source, said flashboard riser comprising: (i) a housing including sidewalls forming an enclosure; (ii) a base secured to said housing and forming a lower portion thereof; (iii) a gate rotatably mounted to said housing along a front portion thereof; (iv) a drain communicating with said enclosure for transporting water from said enclosure; (v) said gate having a panel and at least one panel guide secured to said panel, said at least one panel guide being received in a guide slot formed on said front portion of said housing; (vi) an actuator communicating with said gate to selectively and controllably raise and lower said gate; and wherein said gate is rotatable about an axis by said actuator so that an upper surface of said panel controls water flow over said gate and through said housing.

In another particular aspect of the invention, it may also be considered a flashboard riser system to control flow of water from an impounded water source, said flashboard riser system comprising: (a) a flashboard riser device including a housing, a gate rotatably mounted to said housing along a front portion thereof, a drain communicating with said housing for transporting water from said enclosure, said gate having a panel and at least one panel guide secured to said panel, said panel guide being received in a guide slot formed on said front portion of said housing, an actuator communicating with said gate to selectively and controllably raise and lower said gate, wherein said gate is rotatable by said actuator so that an upper surface of said panel controls water flow over said gate and through said housing; and (b) a controller communicating with said actuator to control operation of said gate, said controller being programmed to execute selected commands to control said gate.

According to yet another particular aspect of the invention, it may also be considered a method of controlling flow of water from an impounded water source, said method comprising:

(i) providing a flashboard riser device including a housing, a gate rotatably mounted to said housing, a drain communicating with said housing for transporting water from said housing, said gate having a panel and at least one panel guide secured to said panel, said panel guide being received in a guide slot formed on said housing, and an actuator communicating with said gate to selectively and controllably raise and lower said gate; (ii) providing a controller communicating with said flashboard riser to control operation of said gate, said controller including at least one user interface enabling a user to select commands to be executed for operational control of said gate; (iii) generating at least one input to said controller for detecting a status of said gate; and (iv) executing at least one output from said controller to complete a command for operational control of said gate, said output resulting in manipulation of said actuator to selectively and controllably raise and lower said gate.

Other features and advantages of the invention will become apparent from a review of the drawings, taken in conjunction with the detailed description which follows.

DETAILED DESCRIPTION

Figure 1:
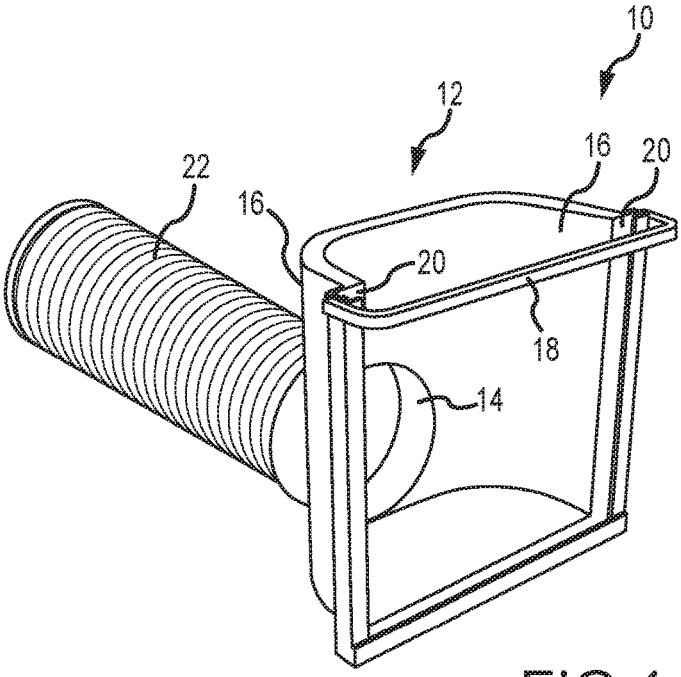
FIG.1 (PRIOR ART)
FIG. 1 is a perspective view of a prior art flashboard riser device.
Figure 2:
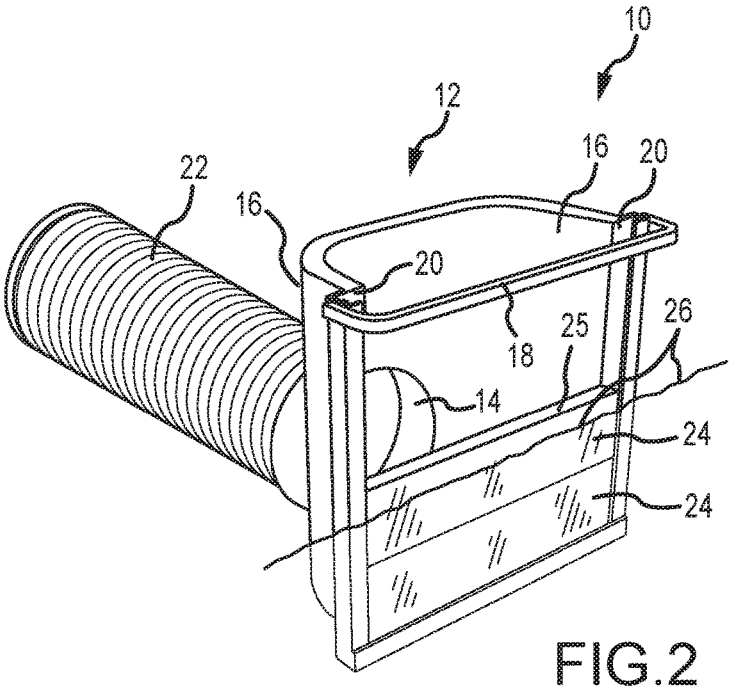
FIG.2 (PRIOR ART)
FIG. 2 is another perspective view of the prior art flashboard riser device of FIG. 1 with one or more boards installed in the device to control water flow.

Referring to FIGS. 1 and 2, one example of a prior art flashboard riser 10 is illustrated. The riser 10 has a housing 12 with a vertically extending sidewall 16. The sidewall 16 forms a partial concave enclosure with an opening 14 formed along a lower central portion of the sidewall 16. The opening 14 communicates with a water conveying tube or pipe 22 that allows water to be carried downstream. The front face of the housing 12 has a pair of opposing board retaining slots 20. The slots are intended to receive one or more boards 24, as shown in FIG. 2. The housing 12 may further include a cross brace or cross support 18 that can be used to manipulate the positioning of the riser 10 during installation or use.

During operation of the riser 10, the boards 24 are placed within the opposing slots 20. The top board 24 has an elevation at its upper surface 25 corresponding to a height of the water column which is intended to be drained if the water column height is above the height or elevation of the upper surface 25. As shown in the example of FIG. 2, the water line 26 is shown as being close to the upper surface 25 of the top board 24.

Figure 3:
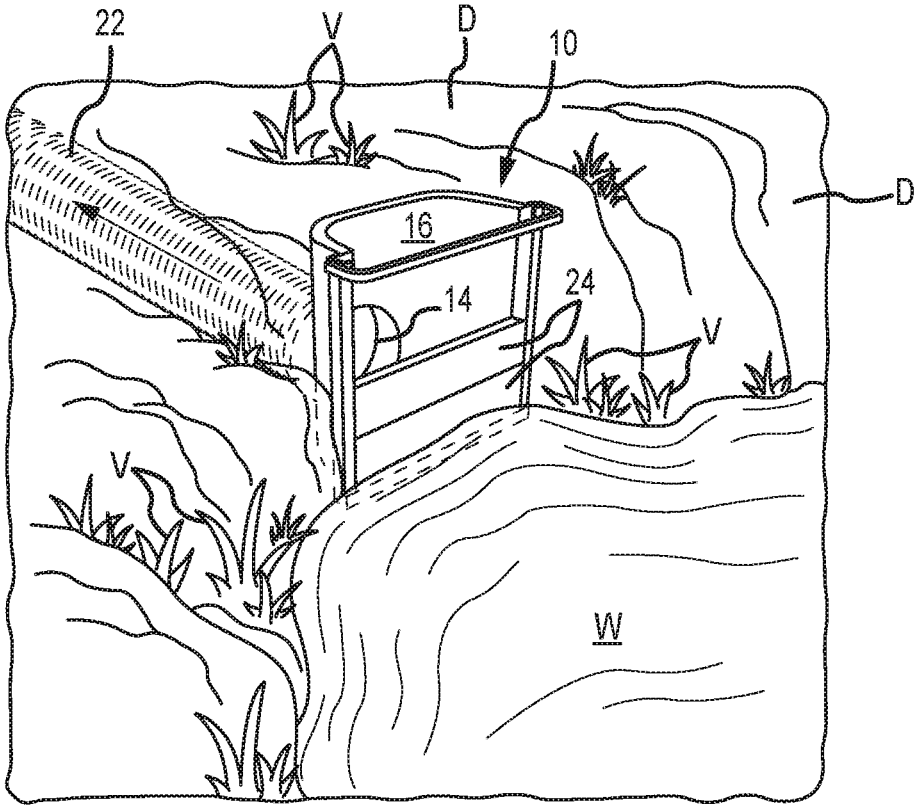
FIG.3 (PRIOR ART)
FIG. 3 is another perspective view of the prior art flashboard riser device of FIG. 1 installed in an impounded body of water.

FIG. 3 illustrates the prior art flashboard riser 10 installed in a containment area in which the riser 10 is used to control downstream flow of water W, such as water in a settling pond. In many typical installations, the settling pond is contained within an earthen dam D. Over time, vegetation V may grow in and around the dam D and therefore, some maintenance may be required to keep the front face of the riser 10 free from obstructions to include vegetation or other objects which may become entangled or caught against the front face of the riser. While flashboard risers similar to that illustrated in FIGS. 1 and 2 have proven to be simple, effective, and reliable water control structures, the flashboard riser of the invention is directed to overcoming some of the problems associated with prior art flashboard risers.

Figure 4:
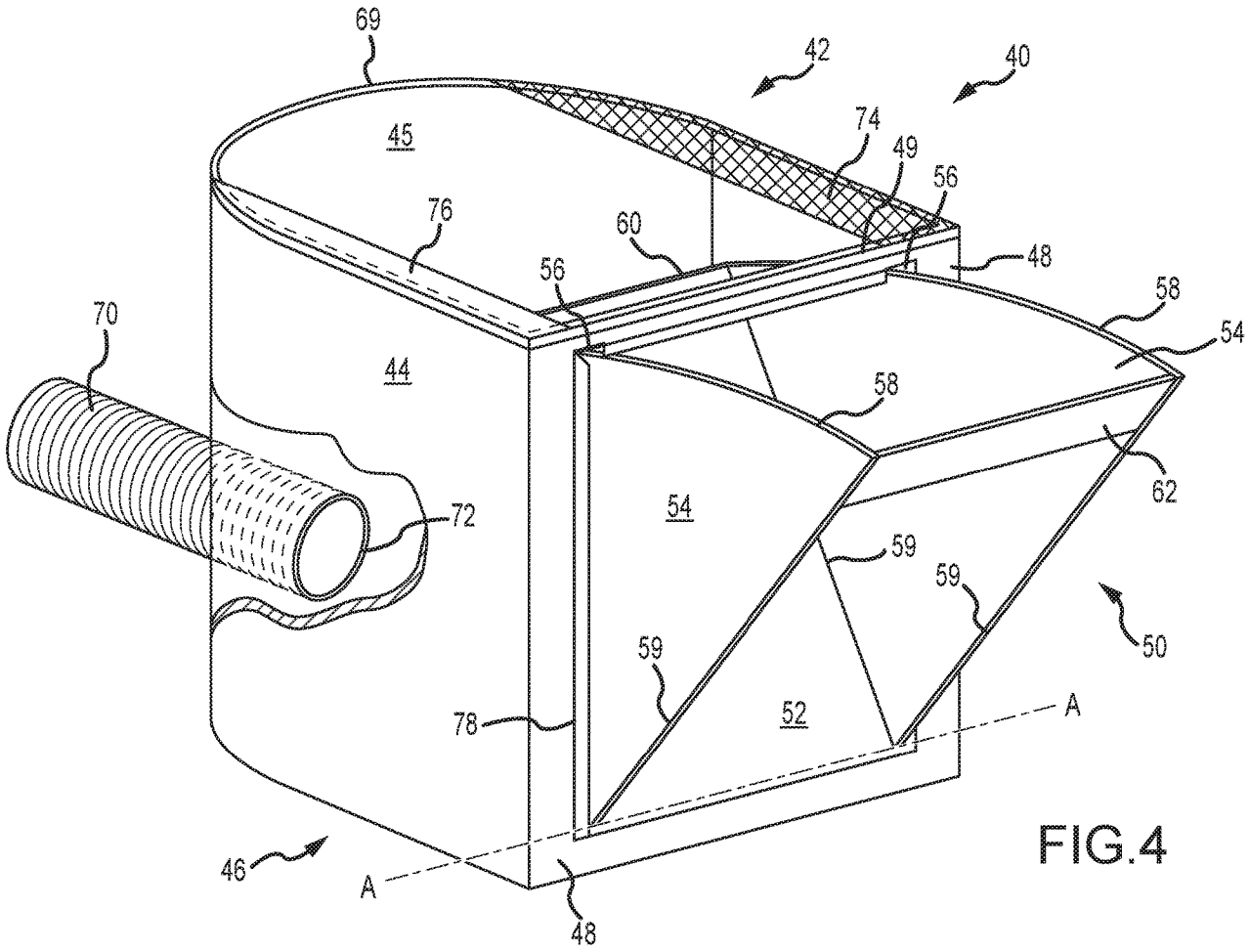
FIG. 4 is a partially fragmentary perspective view of the flashboard riser device of one embodiment of the invention.

Referring to FIG. 4, the flashboard riser of the invention 40 is illustrated in a preferred embodiment. One primary distinguishing feature of the riser 40 is the use of a rotating gate 50 used to control the height of the water column in the body of water in which the riser is installed. Structurally, the riser 40 includes a housing 42 having two substantially parallel sidewalls 44 interconnected by rear curved sidewall 45. Accordingly, the housing in one respect can be characterized as forming a partial enclosure with an open front face which receives the rotatable gate 50. The lower portion of the housing 42 includes a base or bottom surface 46. The side walls 44 and 45 extend substantially perpendicular from the base 46.

The gate 50 is mounted within the front face of the housing 42, and is rotatable about an axis A-A that extends substantially horizontal according to the orientation of the riser as illustrated. The gate 50 has a panel 52 with an upper edge 60 that functions to control the height of the water column allowed to overflow or overtop the panel 52. Two panel guides 54 are secured to the panel 52. The panel guides function to stabilize the rotation of the gate 50 in desired incremental positions as determined by a user. The front face of the housing 42 includes a supporting frame 48. Two opposing guide slots 56 are formed along the upper portion of the supporting frame 48 and are positioned to receive the upper peripheral curved edges 58 of the panel guides 54. As the gate is rotated, the peripheral curved edges 58 of the panel guides 54 remain within the guide slots 56 ensuring smooth and positive control of the panel 52. The upper peripheral curved edges 58 at their highest elevation reside below the upper edge 49 of the housing 42.

The panel guides 54 are arranged such that the panel 52 is attached to one converging side surface 59 of each of the panel guides 54, and the other or opposite converging side surfaces 59 of the panel guides 54 are oriented so that the panel guides 54 extend substantially perpendicular to the panel 52. Optionally, a cross brace 62 may be used to stabilize the position of the panel guides 54. The cross brace 62 spans between and interconnects upper portions of the panel guides 54 at a point proximate to the exposed converging side surfaces 59.

The housing 42 has an opening 72 which communicates with a tube or pipe 70. This tube/pipe 70 allows the water to be transported downstream as it flows through the housing 42. The opening 72 may be positioned in any desired area of the housing 42. For example, the opening 72 may be positioned in the rear curved sidewall 45, the sidewalls 44, or the base 46.

Other illustrated features of the housing 42 include a platform 74 that partially encloses the upper exposed end of the housing 42. The platform 74 can be provided with a skid free surface so that the user may stand upon the platform in order to conduct maintenance or repair of the riser 40. The opposite side of the housing 42 may include a stiffener 76 which provides upper stiffening support to the housing 42. Wiper seals 78 may be located along the vertical edges of the frame 48 to inhabit leakage of water between the exterior surfaces of the panel guides 54 and the front frame 48 as the panel guides 54 rotate in and out of the housing 42.

Figure 5:
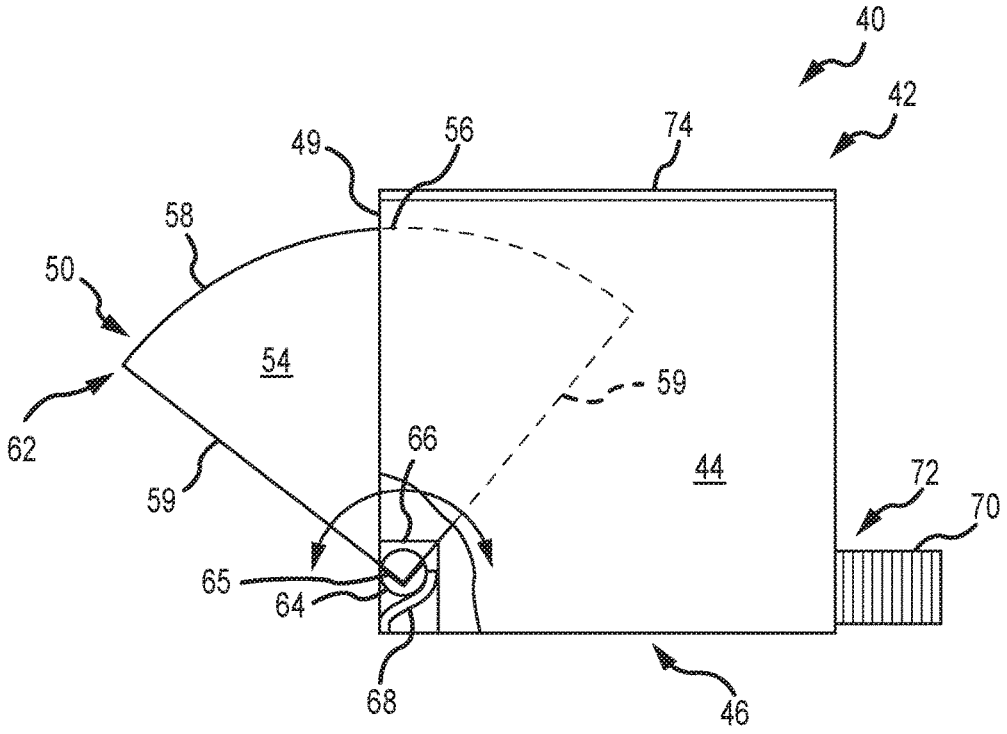
FIG. 5 is a partially fragmentary side elevation view of the flashboard riser device of FIG. 4.

Referring also to FIG. 5, the positioning of the gate 50 is illustrated in its mounted position such that the vertex of the converging side surfaces 59 are mounted to a hinge pin or hinge rod 64 enabling the gate 50 to be selectively rotated. The hinge rod 64 may have a v-shaped channel 65 formed along its length to receive and secure the side surfaces 59 of the panel guides 54. In order to limit or prevent leakage of water through the housing 42 at the location where the hinge rod 64 is mounted, each end of the hinge rod 64 may be sealed with respect to the sidewall 44 of the housing by one or more bellow seals 68 as shown. There are a number of ways in which the hinge rod 64 may be mounted to the housing 42. Depending upon the size of the flashboard riser 40 as well as the particular height and width of the gate 50, the rotation ability of the hinge rod 64 may be enhanced by use of roller bearings (not shown) mounted to the side walls 44 and arranged to receive the respective opposite ends of the hinge rod 64.

FIG. 5 also illustrates a casing 66 that can be used to house and support components associated with mounting of the hinge rod 64 within or against the sidewall 44. The casing 66, for example, can house the corresponding ends of the hinge rod 64, bearings, races to receive the bearings, and seals. The casing 66 may also house components of an actuator that can be used to manually or automatically change the position of the gate 50. For example, the casing 66 can house gears, cable spools, rollers, dampening mechanisms such as torsion springs or oil dampeners, and motors.

Figure 6:
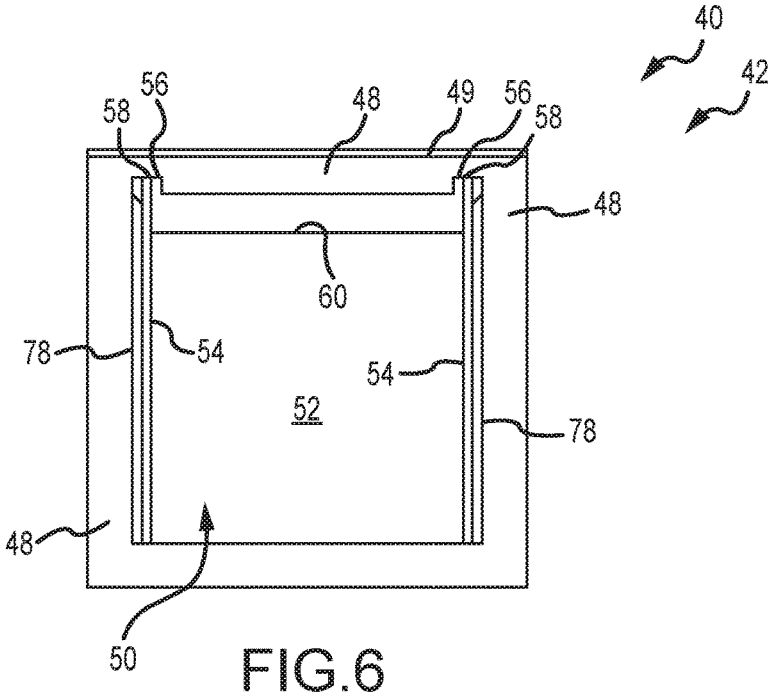
FIG. 6 is a front elevation view of the flashboard riser device of FIG. 4.

Referring to FIG. 6, a front elevation view of the riser 40 is provided and which more particularly illustrates the general relationship of the gate 50 as it is mounted within the frame 48. The cross brace 62 has been removed from the gate for clarity. As shown, the peripheral curved edges 58 of the panel guides 54 are received in the guide slots 56. The upper edge 60 of the panel 52 extends substantially horizontally as shown and is illustrated in a substantially raised position such that the gate 50 is substantially closed.

Figure 7:
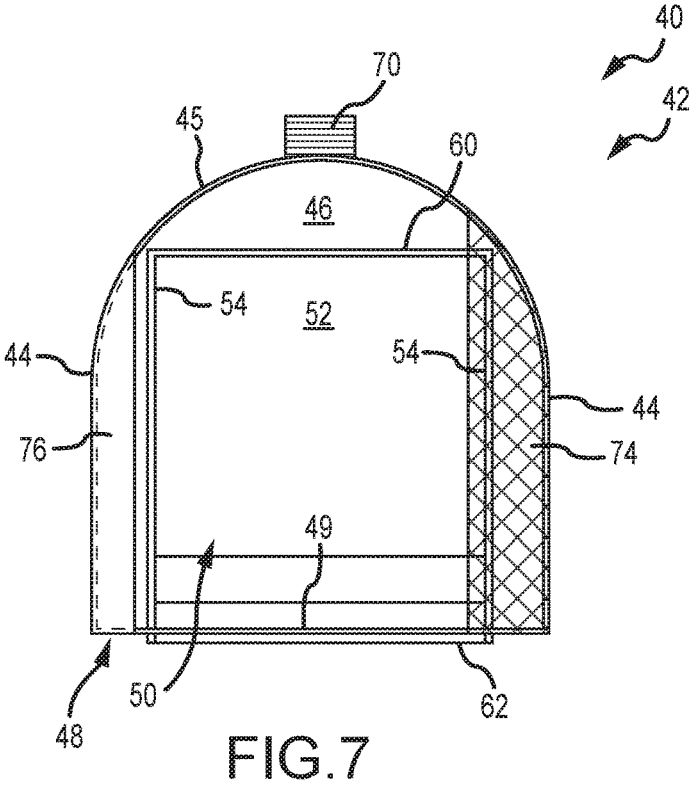
FIG. 7 is a top elevation view of the flashboard riser device of FIG. 4.

Referring to the top elevation view of FIG. 7, further details of the riser 40 are illustrated to include the general size and positioning of the platform 74 and stiffener 76. The platform 74 may be made larger or smaller to best accommodate a stepping and support surface for the user. As also shown, the downstream pipe 70 may be generally centered along the rear curved sidewall 45. FIG. 7 also illustrates the gate 50 in a substantially open position with the panel guides 54 withdrawn into the housing 42.

Figure 8:
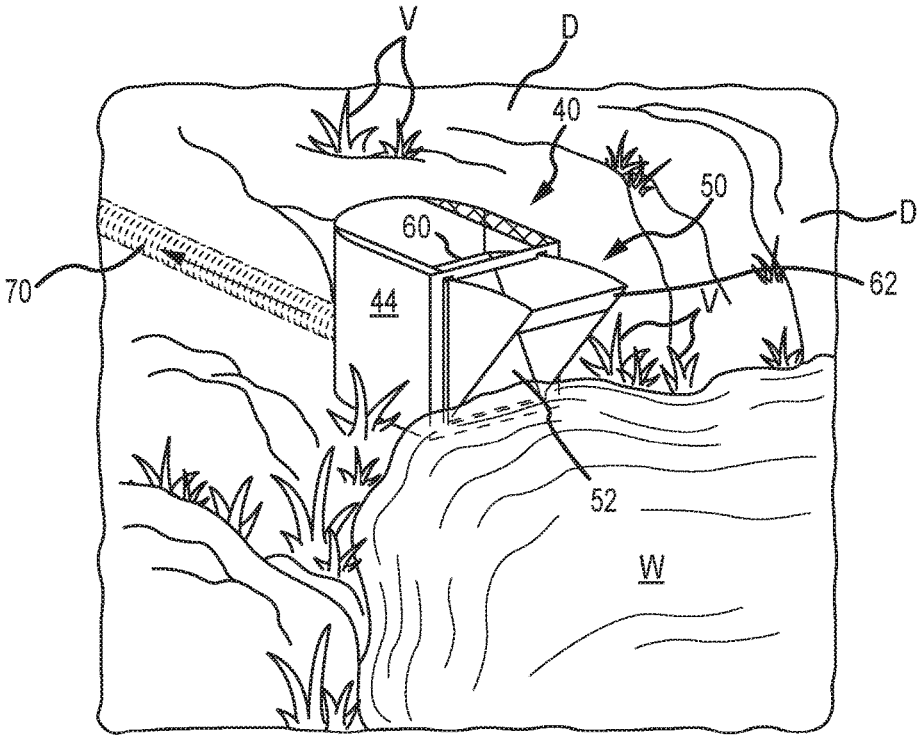
FIG. 8 is a perspective view of the flashboard riser device of the invention installed in an impounded body of water.

Referring to FIG. 8, the riser 40 is illustrated in a containment area similar to the containment area shown in FIG. 3. The riser 40 can be used to control downstream flow of water W, such as water in a settling pond. The settling pond is contained within an earthen dam D, and vegetation V may grow in and around the dam D. Preferably, the sidewalls 44 are oriented substantially vertical so that the upper edge 60 of the panel 52 extends substantially horizontal. In this way, water will be able to uniformly flow over the upper edge 60, and will help to prevent uneven forces or torque against the gate 50 which may otherwise prevent it from smoothly rotating in various incremental positions. Although the riser 40 is illustrated within a particular type of water containment installation, it shall be understood that this is but one type of water containment application in which the riser 40 may be installed. In general, the riser 40 may be installed within any body of water in which a surrounding dam or support structure contains the water, and the riser 40 can be installed at a discharge point for water control purposes.

Figure 9:
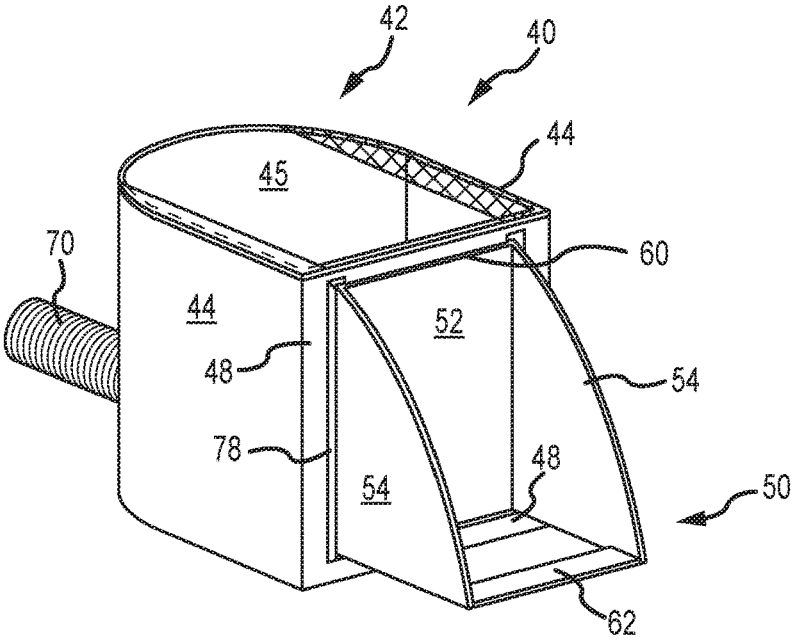
FIG. 9 is a perspective view of the flashboard riser device of the invention with the gate of the device in a fully closed position with the upper edge of the gate raised to the highest position.
Figure 10:
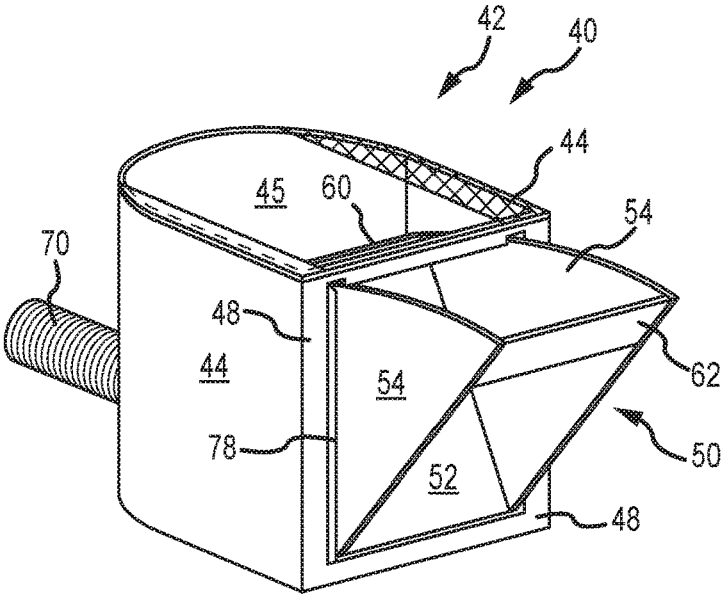
FIG. 10 is a perspective view of the flashboard riser device of the invention with the gate of the device in a partially open position with the upper edge of the gate in a partially raised or partially lowered position.
Figure 11:
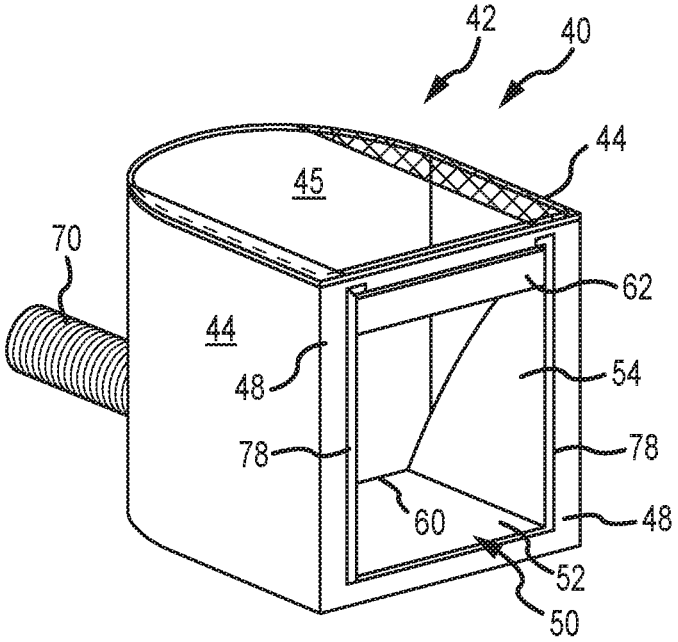
FIG. 11 is a perspective view of the flashboard riser device of the invention with the gate of the device in a fully open position with the upper edge of the gate lowered to the lowest position.
Figure 12:
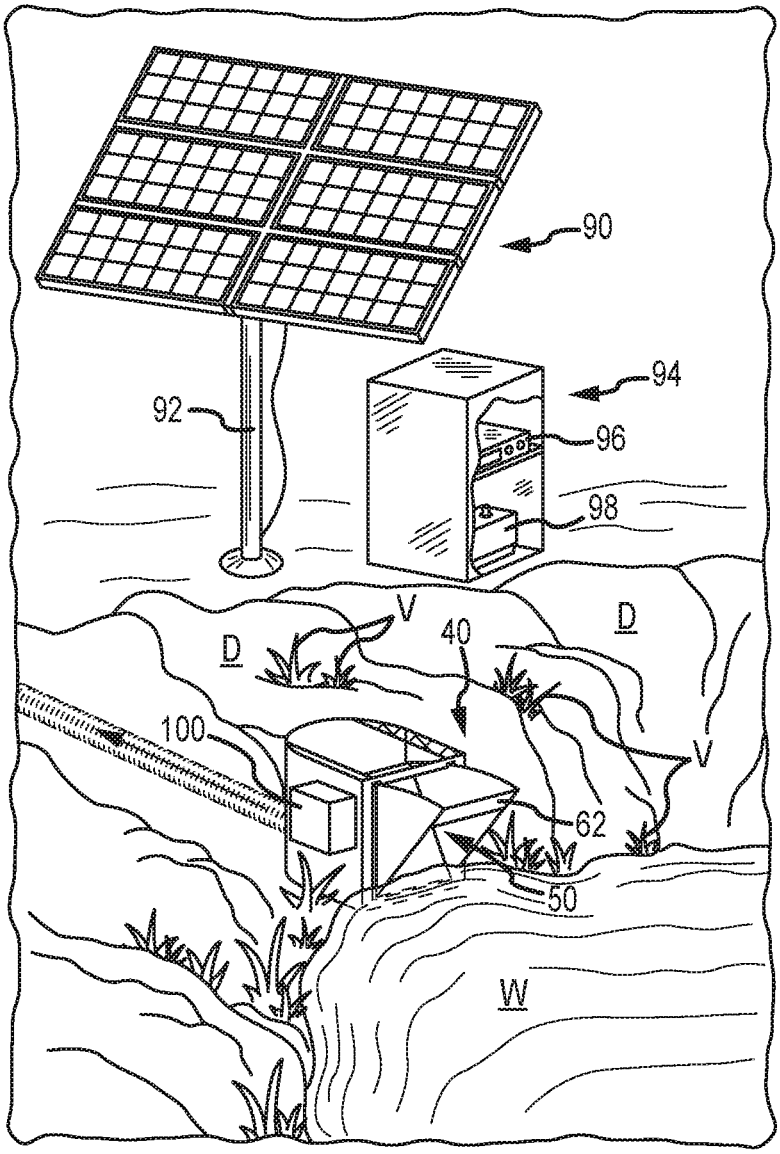
FIG. 12 is a perspective view of the flashboard riser device of the invention installed as shown in FIG. 8, and further illustrating system components including solar panels for a power source, a controller for automatic control of the flashboard riser device, an inverter, a battery, and a control motor.

FIGS. 9-11 illustrates various positions that the gate 50 may be positioned in order to serve as a water control structure. FIG. 9 illustrates a fully raised gate position in which the gate is rotated so that the panel 52 extends substantially perpendicular. Accordingly, the upper edge 60 in this position is at its highest elevation. This position requires the gate 50 to be fully rotated so that the panel guides 54 fully protrude from the front frame 48 of the housing 42. FIG. 10 illustrates a partially raised or partially lowered position in which the gate 50 has been rotated counterclockwise according to the view in this figure. Accordingly, the height of the upper edge 60 is lowered compared to the position illustrated in FIG. 9. FIG. 11 illustrates a fully lowered gate position in which the gate 50 is rotated further counterclockwise so that the panel 52 extends substantially horizontal. Accordingly, the panel guides 54 and panel 52 are received and withdrawn into the housing 42, and the upper edge 60 is at its lowest elevation. The depth of the space within the housing 42 is such that it may receive the panel 52 and panel guides 54 in this lowered gate position. One can appreciate from review of FIGS. 9-11 that the gate 50 may be raised or lowered in an infinite number of positions to accommodate a desired water column level In another embodiment of the invention, FIG. 12 illustrates an automated flashboard riser system that can be used for remote and automatic control of the riser 40. Reference numeral 100 generally represents a motor that is mounted to the housing of the riser 40. The motor may be used to rotate or change the position of the gate 50. The motor may be controlled automatically by a controller operated by the user. Accordingly, FIG. 12 also illustrates a control center 94 which may house a controller 96, such as a micro-industrial controller. The controller 96 may communicate by wire or wirelessly with the motor 100. The controller 96 may be programmed to operate the gate 50 and therefore manipulate positioning of the gate 50 in the desired orientation with respect to height of the water column in the impoundment area. FIG. 12 also illustrates one example of how the motor 100 may be independently powered, such as by solar panels 90 mounted locally to the riser 40. Pole mounted panels 90 can be used in which the solar panels 90 can be selectively oriented at a desired orientation with respect to the sun by manipulating the mounting structure, such as the pole 92. The control center 94 may also house a battery 98 used to store electrical energy generated by the solar panels 90. Other equipment may be housed within the control center such as an inverter (not shown) for the solar panels. Alternatively, the motor 100 itself may have its own integral battery power source, or the motor 100 may be powered by conventional grid power.

Although the riser 40 may be automatically controlled, another aspect of the invention allows for manual control of the gate 50 for various reasons. For example, one or more of the risers may be installed in particularly isolated or difficult to access location, and it may be preferable to manually control such isolated riser(s) due to the cost or difficulty in installing a local power source. Accordingly, the actuator of the invention is adapted to receive a manual hand crank or other hand implement used to selectively rotate the gate in the desired position. As mentioned, one example for manual control may include use of a ratchet gear in which a hand crank manipulates the ratchet gear to the desired setting. The gate in this example is manually controlled by turning the crank by hand to position the gate in the desired angular orientation. Indexing of desired or pre-set gate positions may be accomplished manually by sight referenced markers placed on the panel guides 54 and indexed with a point located on the actuator such as a point placed on a gear or on mechanical linkage used to rotate the gate. As mentioned, incremental control of the position of the gate may be assisted by use of dampening devices, such as a torsion spring or an oil dampener in which the gate is prevented from relatively free rotation without overcoming the spring or dampening force. A dampening device may also be used to control the speed at which the gate is allowed to raise or lower, which provides a design feature for the gate to match incremental and changing settling pond conditions so that water is preferably only slowly released at the very top of the water column until the gate reaches a new operator set position.

Automatic control by use of a controller may be achieved in which very small incremental positions of the gate can be set and changed. Inputs to the controller may include limit switches or optical sensors that detect positioning of the gate. Based on these inputs, output control signals can be generated to adjust the positioning of the gate. Other inputs to the controller may include level switch indicators that detect the level of the water column and which may trigger a programmed response to reposition the gate. For example during a rain event, it may be desirable to raise the level of the gate to prevent excessive overflow of water through the riser.

In connection with automatic control, the invention further includes user options to program operation of the riser, and to independently set or override a programmed aspect of the control. The controller includes software or firmware enabling the programmable aspect of the system. Various user interfaces are provided to enable the user to select and control system operation. For example, with respect to the slow fall option associated with a slow and controlled lowering or falling of the gate, the program can instruct signals to the motor to gradually but slowly lower the gate until the set position is achieved. It is also contemplated that there can be automatic control provided directly at the field location where the riser is installed with simplified commands. For example, an input module may be connected directly to the motor with a limited number of control buttons to manipulate positioning of the gate. Examples of such simplified control could be an input module with separate buttons to "Raise", Lower", "Slowly Raise" or "Slowly Lower" the gate.

Another programmable option for the automated riser of the invention is to utilize a programmable and removable chip associated with an onboard controller of the motor. More specifically, a very simple and economical controller may be provided with the motor in which a programmable chip may be programmed and reprogrammed as necessary. One particular software protocol that may be used in conjunction with programming of a controller of the system may be use of Supervisory Control and Data Acquisition type software (SCADA software). This software example is one which is specifically designed to be incorporated within a system that controls a number of remote and distinct types of field devices, such as wells, irrigation valves, etc.

The invention further includes data acquisition and retention regarding history of operation for the automated riser of the invention. Such data may include gate index positions, gate position history, gate position history as a function of environmental conditions, etc. The data may also include the rate of water flowing through the riser device or the volume of water that has passed through the riser device. The water volume and water flow rate data may be received from a flow meter positioned within the device. This data can be used to further refine system programming and to improve system predictability and performance.

Other aspects of operation and programmable control of the system include monitoring inputs. As mentioned, inputs to the controller may include various switches, sensors, timers, and the like. Specific examples of monitored conditions may include the current gate position, a history of gate position changes over a specified period of time, a battery charge status, and alarm or alert status history. In connection with an alarm or alert status, various conditions may trigger an alarm or alert such as an out of range water level condition with respect to the column of water being controlled by the riser, failed gate setting changes, a low battery condition, a freeze alert in which the body of water is frozen and may therefore prevent proper drainage, and various types of mechanical failures sensed by system inputs. Additional examples of monitored conditions may include a rainfall history, such as measured by an electronic rain gauge that communicates with the system, a soil moisture condition as measured by a soil moisture probe that communicates with the system, current weather and historical weather conditions obtained from various weather information services, still photo data as captured by one or more cameras which communicate with the system, and various water level sensors integrated within the system. It should be understood that this is not an exclusive and exhaustive listing of potential monitored inputs to the system, and that others may also be considered as other factors may affect optimal operation and performance of the automated riser.

While the invention is disclosed herein in one or more preferred embodiments, it shall be understood that various changes and modifications can be made to the invention commensurate with the scope of the claims appended hereto.

What is claimed is:

1. A device to control flow of water from an impounded water source in which the device is installed, the impounded water source having sidewalls and a bottom, said device comprising:

a housing including sidewalls, a rear wall, and a base forming an enclosure;

said base secured to said housing and forming a lower portion thereof;

a supporting frame formed on a front face of the housing and interconnecting said sidewalls;

wherein said side walls include two sidewalls spaced from one another by a width of said device defined by a width of said supporting frame;

a gate rotatably mounted to said housing along said supporting frame;

a pipe connected to said enclosure for transporting water away from said enclosure;

said gate having a panel and at least one panel guide secured to said panel, said at least one panel guide having an upper surface received in a guide slot formed on an upper portion of said supporting frame of said housing, and said at least one panel guide having a converging side surface attached to said panel;

an actuator communicating with said gate to selectively and controllably raise and lower said gate; and wherein said device is installed in the impounded water source, and said gate is then rotatable about an axis by said actuator so that an upper surface of said panel controls water flow over said gate and through said housing.

2. The device, as claimed in claim 1, wherein:

said at least one panel guide includes two panel guides, a first panel guide of said two panel guides being secured to one side edge of said panel, and a second panel guide of said two panel guides being secured to an opposite side edge of said panel.

3. The device, as claimed in claim 2, wherein:

said guide slot includes two guide slots, each guide slot being positioned to receive a corresponding panel guide of said gate.

4. The device, as claimed in claim 1, wherein:

said gate is rotatable about a hinge rod mounted to said housing and connected to respective lower ends of said panel and said at least one panel guide.

5. The device, as claimed in claim 1, wherein:

said actuator comprises a cable attached to said gate, said cable being retracted and extended in order to selectively and controllably raise and lower said gate.

6. The device, as claimed in claim 1, wherein:

said at least one panel guide has an arcuate upper surface enabling said arcuate upper surface to remain within said guide slot as said gate is rotated during operation.

7. The device, as claimed in claim 1, wherein:

said upper surface of said panel extends substantially parallel to said axis of rotation.

8. The device, as claimed in claim 1, wherein:

said housing further includes at least one platform mounted to an upper surface of said housing.

9. The device, as claimed in claim 1, wherein:

said housing further includes at least one stiffener mounted to an upper surface of said housing.

10. The device, as claimed in claim 1, wherein:

said side walls include two substantially parallel spaced sidewalls and a rear curved sidewall interconnecting said parallel spaced sidewalls.

11. The device, as claimed in claim 10, wherein:

said pipe is mounted to said rear curved sidewall.

12. A system to control flow of water from an impounded water source, the impounded water source having sidewalls and a bottom, said system comprising:

(a) a device including a housing having sidewalls, a rear sidewall, and a base forming an enclosure, a gate rotatably mounted to said housing along a front portion thereof, a water conveying tube connected to said housing for transporting water from said enclosure, said gate having a panel and at least one panel guide secured to said panel, said at least one panel guide having an upper surface received in a guide slot formed on an upper portion of said front portion of said housing, and said at least one panel guide having a converging side surface attached to said panel, and an actuator communicating with said gate to selectively and controllably raise and lower said gate, (b) a controller communicating with said actuator to control operation of said gate, said controller being programmed to execute selected commands to control said gate; and wherein said device is installed in the impounded water source, and said gate is rotatable by said actuator so that an upper surface of said panel controls water flow over said gate and through said housing.

13. The system, as claimed in claim 12, further including:

an integral power source for powering said controller and said actuator.

14. The system, as claimed in claim 12, wherein:

said actuator includes a motor and mechanical means communicating with said gate to selectively and controllably raise and lower said gate.

15. The system, as claimed in claim 14, wherein:

said mechanical means comprises at least one of gears, cable spools, rollers, dampening mechanisms including torsion springs or oil dampeners, and motors.

16. The system, as claimed in claim 14, further including:

user interfaces associated with said controller providing a user options to program and select features relating to system control.

17. The system, as claimed in claim 16, wherein:

said user interfaces provide functionality to execute operation and control of said gate in response to inputs to said controller.

18. A method of controlling flow of water from an impounded water source to accommodate a desired water column level, said method comprising:

assembling a device including a housing having sidewalls, a rear sidewall, and a base forming an enclosure, a gate rotatably mounted to said housing, a water conveying tube connected to said housing for transporting water from said housing, said gate having a panel and at least one panel guide secured to said panel, said at least one panel guide having an upper surface received in a guide slot formed on an upper portion of a front face of said housing , said at least one panel guide having a converging side surface attached to said panel, and an actuator communicating with said gate to selectively and controllably raise and lower said gate;

providing a controller communicating with said device to control operation of said gate, said controller including at least one user interface enabling a user to select commands to be executed for operational control of said gate;

installing the device in the impounded water source;

generating at least one input to said controller for detecting a status of said gate; and executing at least one output from said controller to complete a command for operational control of said gate, said at least one output resulting in manipulation of said actuator to selectively and controllably raise and lower said gate; and wherein a selected position of said gate results in control of a height of a water column by water that flows through said housing and over an upper edge of said panel and said gate is rotatable by said actuator so that an upper surface of said panel controls water flow over said gate and through said housing.

* * * * *